US006792225B2

(12) United States Patent
Sugano et al.

(10) Patent No.: US 6,792,225 B2
(45) Date of Patent: Sep. 14, 2004

(54) SWITCH AND IMAGE FORMING APPARATUS

(75) Inventors: Masashi Sugano, Hachioji (JP); Tadashi Matsudaira, Hachioji (JP); Hiroshi Oyama, Hino (JP); Katsunori Takahashi, Hachioji (JP); Masayuki Watanabe, Fuchu (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/423,267

(22) Filed: Apr. 25, 2003

(65) Prior Publication Data

US 2003/0214375 A1 Nov. 20, 2003

(30) Foreign Application Priority Data

May 14, 2002 (JP) ..... 2002-138352

(51) Int. Cl.[7] ..... H01F 9/00; H01F 7/00; H01F 7/08; G03G 15/00

(52) U.S. Cl. ..... 399/88; 335/181; 335/229; 335/234

(58) Field of Search ..... 399/88; 335/177, 335/179–183, 229, 230, 234, 205, 206, 207

(56) References Cited

U.S. PATENT DOCUMENTS 6,492,887 B1 * 12/2002 Diem et al. ..... 335/78

* cited by examiner

*Primary Examiner*—Ramon M. Barrera
(74) *Attorney, Agent, or Firm*—Frishauf, Holtz, Goodman & Chick, P.C.

(57) ABSTRACT

A switch of the present invention is featured as one employing:

a contact to make and break an electrical circuit, and an electromagnet, both of which are installed in a case, and a handle to make and break the contact by operation from outside of the case, wherein a permanent magnet is installed with one of its poles facing the electromagnet inside of the handle, and wherein the direction of the current passing through the electromagnet is changed so that the permanent magnets are attracted to or released from the electromagnet, and thereby the contact is opened or closed.

13 Claims, 7 Drawing Sheets

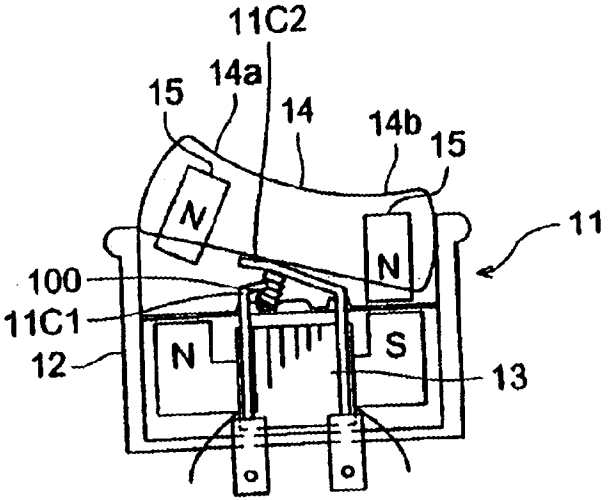
FIG. 8 ( b )
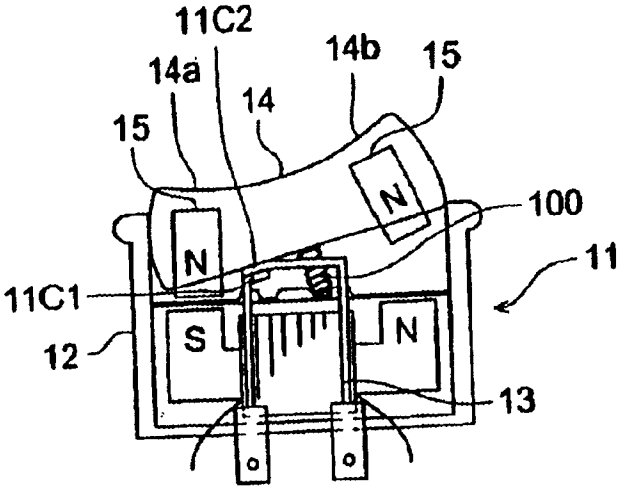
FIG. 8 ( a )

SWITCH AND IMAGE FORMING APPARATUS

BACKGROUND OF THE INVENTION

The present invention relates to a multifunctional and energy saving typed image forming apparatus which even a physically handicapped person having a visual disorder can operate easily, and a special switch used in the above-mentioned image forming apparatus.

Due to the multifunctional operation of the image forming apparatus, concerning a power switch, used are two kinds of such switches, one is used on the assumption that it will not be used for normal condition, while the other is used on the assumption that it will be used frequently. An example of the former is a main power switch, and an example of the latter is an operational power supply switch.

When the main power switch is ON, and the operational power switch is OFF, the image forming apparatus is under energy saving condition, and therefore the energy consumption is lower, though the image forming apparatus remains multifunctional.

When the main power switch is ON, and the operational power switch is also ON, and when the image forming apparatus has not been operated for a predetermined time, the apparatus turns itself OFF automatically, by which energy saving can be performed, which is preferable from the point of view of global environmental conservation.

FIG. 5 is a perspective view of a conventional image forming apparatus. Image forming apparatus 51 is composed of document feeding device 52 which feeds the documents to a unillustrated glass platen, operational section 53, by which a user designates operations to image forming apparatus 51, image forming section 54 which forms images on a transfer sheet, and sheet trays 55 which convey paper sheets, one by one, to image forming section 54.

Operational power supply switch 56 is a push-type switch, provided on operational section 53. The push-type switch is structured so that the power supply is turned on and off by each push, and the button of a push-type switch returns to the original position, accordingly it is impossible to show the condition of ON or OFF by the appearance of the switch.

Main power switch 57 is a seesaw switch. The seesaw switch is structured so that a push to one side is the ON position, and a push to the other side is the OFF position, accordingly a push on the seesaw switch shows whether it is ON or OFF.

FIG. 6 is a block diagram of the image forming apparatus. Condition control section 61 is composed of an unillustrated CPU, a control program of image processing means 62, and a memory device to memorize the control program, and page memory 63 which temporally stores readout images. Control section 53 and document feeding device 52, both of which are also shown in FIG. 5, FAX control section 64, printer control section 65, network interface 66, and image output section 67, are connected to condition control section 61, and all of them function based on instructions from condition control section 61.

FAX control section 64 is a device which sends or receives images through a telephone circuit, and printer control section 65 controls image forming section 54 as well as sheet tray 55, also shown in FIG. 5, and forms the images stored in page memory 63 on the transfer sheet. Condition control section 61 is connected to network interface 66, which is used for forming the images on the transfer sheet by the printing instruction from a computer on a LAN, and is used for sending the image data in page memory 63 to the computer on the LAN.

Image forming apparatus 51 uses a switch for activating or deactivating the primary side voltage, and a switch for activating or deactivating a secondary side voltage. Total control of the power supply of image forming apparatus 51 is realized by activating or deactivating the primary side voltage, while the control of the power supply of the sections, except condition control section 61, FAX control section 64 and network interface 66 is performed by activating or deactivating the secondary side voltage. Main power supply switch 57 is used for turning on and off the primary side voltage, while operational power supply switch 56 is used for turning on or off the secondary side voltage.

ON/OFF operation of operational power supply switch 56 can be directly controlled by condition control section 61. When a FAX or instruction for printing from a computer arrives, while operational power supply switch 56 is off, condition control section 61 can automatically turn on operational power supply switch 56, to printout the received images onto a transfer sheet. Further, when the printing is completed, power is automatically turned off.

If main power switch 57 is turned off, it is impossible to receive a FAX or instruction for printing from the computer, and accordingly, main power switch 57 normally remains in the ON position, and it is not turned off except in special cases, such as when image forming apparatus 51 is transported.

If a switch is used which does not show the on-off condition, such as commonly used operational power supply switch 56, it is almost impossible to recognize the operating condition of image forming apparatus 51 for a physically handicapped person having a visual disorder. A switch that can show the condition of ON/OFF, such as a seesaw switch used in main power supply switch 57 should be used from the point of view of universal design.

When a switch, such as a conventional seesaw switch that shows the ON/OFF condition is used, it is still impossible to control the ON/OFF switch condition by condition control section 61. For its countermeasure, the image data received by FAX control section 64 and network interface 66 is memorized in page memory 63, whereby, when the amount of the data is very large, there is a risk that the memorized data will overflow.

Further, by such a seesaw switch, it is impossible to perform remote control of the power supply of image forming apparatus 51 which is connected to a network environment, and a person must take the trouble to go to image forming apparatus 51 to turn on the power supply, which is rather inconvenient.

Still further, a conventional power supply switch having an electromagnetic reset function, can work only for cutting off the circuit, which cannot be used for the operational power supply switch.

In order to avoid this problem, considered is a method that only ON/OFF switching of control section 53 is performed by operational power supply switch 56, and that the apparatus is activated while operating section 53 is off, whichever the condition of operational power supply switch 56 may be. However this is still not a preferable operating method, because the countermeasure of an abnormal event such as a paper jam can become quite complicated.

Among conventional switches, a switch exists having one directional electromagnet and a permanent magnet, by which the circuit is turned off not only by an electric signal but also by a manual push. However such a switch can be turned from on to off, but cannot be turned from off to on. Accordingly, when information such as a FAX message enters during the energy saving mode (that is, the operational switch is off), it is necessary to save the information in a memory means, or to allow the image forming apparatus to function, though the operational switch is off. In the former case, an enormous volume of memory is necessary, and in the latter case, it is not logical that the machine works though the switch is off.

According to the present invention, the switch can be turned on to off, and off to on, by electrical signals or manual operation. Therefore, for changing to energy saving mode, the operational switch is turned off by manual operation or electrical signals, and when communication information enters from the outside, the operational switch is turned on by the electrical signals to receive the communication information, and when receiving is completed, the operational switch is turned off by electrical signals to be in the energy saving mode. That is, a multifunctional operation is established for the image forming apparatus.

SUMMARY OF THE INVENTION

The object of the present invention is to provide a switch that can be activated or disactivated at the condition control section, though it is a switch whose operational condition can be identified and to provide the image forming apparatus employing the switch.

In order to attain the above-mentioned object, a switch of the present invention is featured as one employing:

a contact to make and break an electrical circuit, and an electromagnet, both of which are installed in a case, and a handle to make and break the contact by operation from outside of the case, wherein a permanent magnet is installed with one of its poles facing the electromagnet inside of the handle, and wherein the direction of the current passing through the electromagnet is changed so that the permanent magnets are attracted to or released from the electromagnet, and thereby the contact is opened or closed.

It is also possible to constitute the switch to be the seesaw type switch, and further, to attach permanent magnets with the same pole facing the electromagnet at both ends of the handle.

In order to attain the above-mentioned objective, an image forming apparatus of the present invention is featured as one employing:

an image forming section for forming images on a transfer sheet, an operational section by which the user activates the image forming apparatus, a condition control section for controlling the image forming section and the operational section, a main power supply switch for directly turning on or off a primary side voltage of the image forming apparatus, and an operational power supply switch that is able to detect the switch condition of a secondary side voltage being turned on or off by the condition control section, wherein the operational power supply switch is the switch of the present invention.

Further, it is possible to feature an image forming apparatus in that, when the image forming apparatus is not operated for more than a predetermined time interval, though both the main power supply switch and the operational power supply switch are in the ON condition, electrical signals are given to the operational power supply switch so that the switching condition is turned OFF, after which the electric wattage of the image forming apparatus is shifted to a lower consumption condition, still further, when the image forming apparatus receives operational instructions from the outside, electrical signals are given to the operational power supply switch so that the switch is turned ON, then the electrical wattage of the image forming apparatus is shifted to a higher consumption condition.

BRIEF DESCRIPTION OF THE DRAWINGS

FIG. 8(*a*) shows the electrical and mechanical structure of switch 11 of the present invention, wherein contacts 11C and 11C2 are connected.

FIG. 8(*b*) shows the electrical and mechanical structure of switch 11 of the present invention, wherein contacts 11C and 11C2 are disconnected.

DETAILED DESCRIPTION OF THE PREFERRED EMBODIMENT

Figure 1:
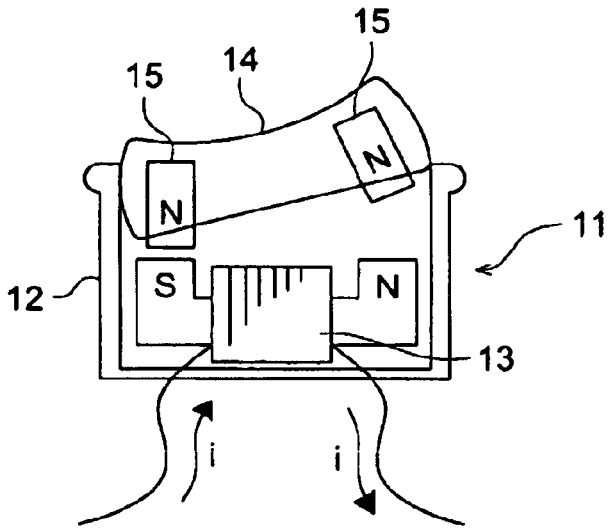
FIGS. 1(*a*) and 1(*b*) are drawings showing the functional principles of a switch of the present invention.
Figure 1:
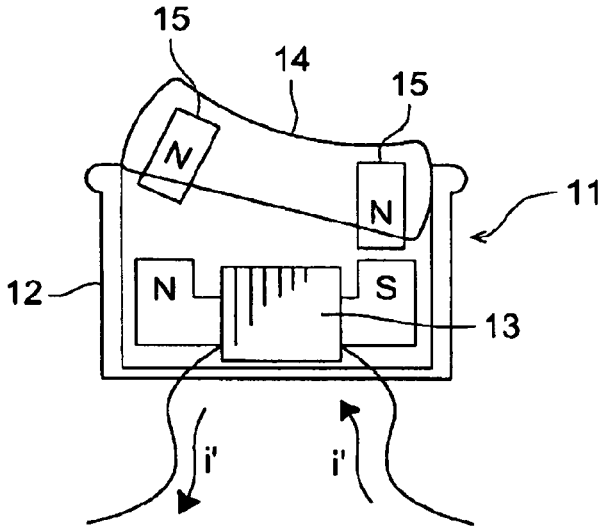

Embodiments of this invention will be described referring to the drawings.

FIGS. 1(*a*) and 1(*b*) are drawings showing the functional principles of the switch of the present invention. Switch 11 is a seesaw switch. Concerning switch 11, electromagnet 13 and unillustrated electrical contacts for turning ON an electric circuit are housed in resin case 12, and handle 14 for making or breaking the electrical contacts is integrated on top of case 12

Figure 3:
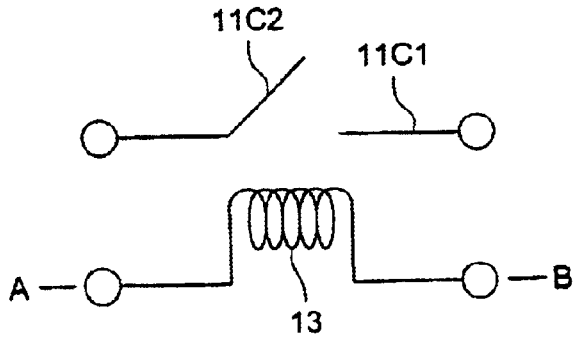
FIG. 3 is a circuit diagram showing a switch of the present invention.
Figure 7:
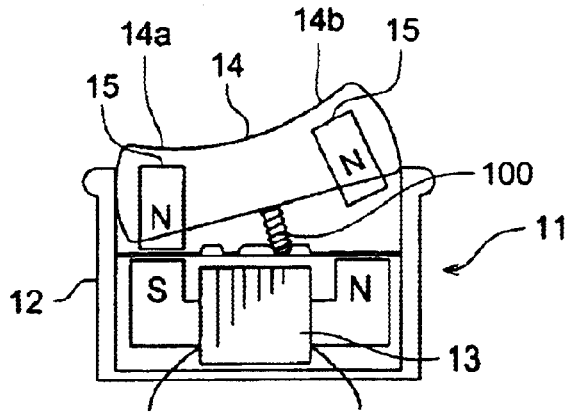
FIGS. 7(*a*), 7(*b*), and 7(*c*) are drawings showing a spring and a handle of the present invention.
Figure 7:
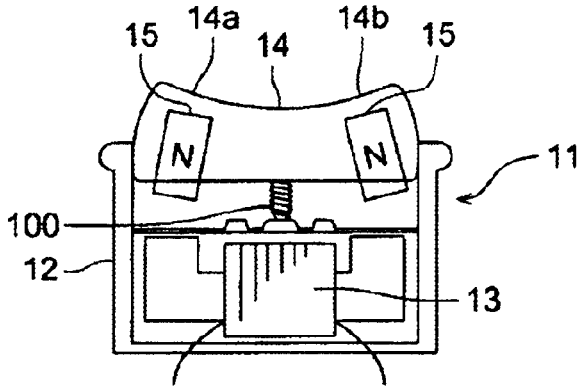
Figure 7:
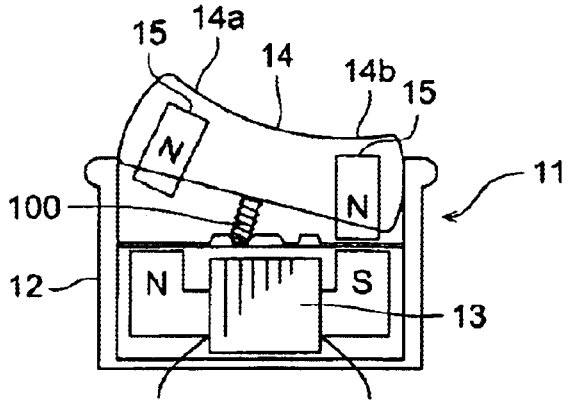

The left side of handle 14 is first push-section 14*a*, and the right side of handle 14 is push-section 14*b*, as shown in FIGS. 7(*a*), 7(*b*) and 7(*c*). As shown in FIGS. 3, 8(*a*) and 8(*b*) electrical contacts 11C2 and 11C1 are provided for switching the electrical circuit on and off. The electrical contact 11C2 moves in an interlocking manner with the handle 14, as seen in FIGS. 8(*a*) and 8(*b*).

Electromagnet 13 is one in which a copper wire is formed into a coil and an iron core is inserted into the coil. The iron core is U-shaped, with both ends facing upward. Handle 14 is formed of resin, housing permanent magnet 15 inside it. Permanent magnets 15 are attached on both ends of handle 14, and N poles of both permanent magnets 15 face electromagnet 13. It is also possible to structure S poles to face electromagnet 13, because it is necessary that the same poles of permanent magnet 15 face electromagnet 13. Further, it is necessary that permanent magnet 15 is installed on at least one end of handle 14. Spring 100, for supporting handle 14 is installed in switch 11. The spring helps ON/OFF movement of handle 14, and there are cases that the spring is not necessary, based on the magnetic power of electromagnet 13.

When electric current "i" flows in the arrowed direction shown in FIG. 1(*a*) in switch 11, the left end of the iron core of electromagnet 13 is the S pole, while the right end is the N pole. Permanent magnet 15 attached on the left end of handle 14, is attracted by the S pole of electromagnet 13, while permanent magnet 15 on the right end is repelled by the N pole of electromagnet 13. Accordingly, the handle 14 is slanted as shown in FIG. 1(*a*), and the contacts 11C1 and 11C2 are connected (see FIG. 8(*a*).

When electric current "i'" flows in the opposite direction shown in FIG. 1(*b*), S pole and N pole of electromagnet 13 are reversed, and the handle 14 is slanted in the direction opposite that shown in FIG. 1(*a*), and the contacts 11C1 and 11C2 are disconnected (see FIG. 8(*b*). In the above-cited explanation, FIG. 1(*a*) shows a closed contact, while FIG. 1(*b*) shows an opened contact, however, it is possible to design a switch so that FIG. 1(*a*) shows the opened contact, while FIG. 1(*b*) shows the closed contact.

Figure 2:
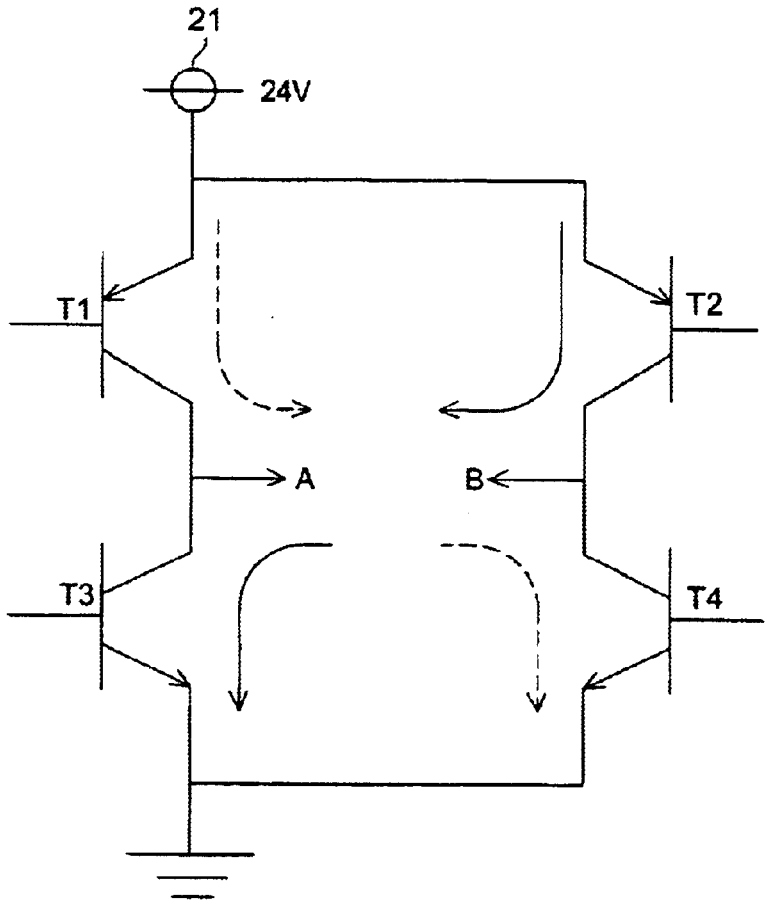
FIG. 2 is a circuit diagram describing reversing of the electric current.

In order to change the direction and flow of the electric currents as shown in FIG. 1(*a*) and FIG. 1(*b*), a circuit shown in FIG. 2 is used. The circuit shown in FIG. 2 is composed of electric power supply 21, and transistors T1, T2, T3, and T4 which are connected to electric power supply 21. The coil of electromagnet 13, shown in FIG. 1, is connected between "A" and "B" shown in FIG. 2. FIG. 3 shows the coil representing electromagnet 13 and the contacts 11C1 and 11C2 of switch 11. The contacts 11C1 and 11C2 of switch 11 are connected to a circuit for making and breaking the operation power supply of image forming apparatus 51. There is no need to flow electrical currents "i" and "i'" for a long time, the time is set so that the electromagnet attracts and repels the permanent magnets, and the attracted and repelled condition is kept by spring 100 shown in FIGS. 7(*a*), 7(*b*), and 7(*c*).

Among the transistors shown in the circuit diagram in FIG. 2, to turn on transistors T1 and T4 results in an electric current flow from A to B in the dotted-arrow direction. This corresponds to the condition shown in FIG. 1(*a*). Further, to turn on transistors T2 and T3 results in the electric current flow from B to A in the solid-arrow direction. This corresponds to the condition shown in FIG. 1(*b*). Switch 11, shown in FIG. 3, has a contact, however it is not limited to this, and the principles of the present invention can be applied to a switch having two contacts.

Figure 4:
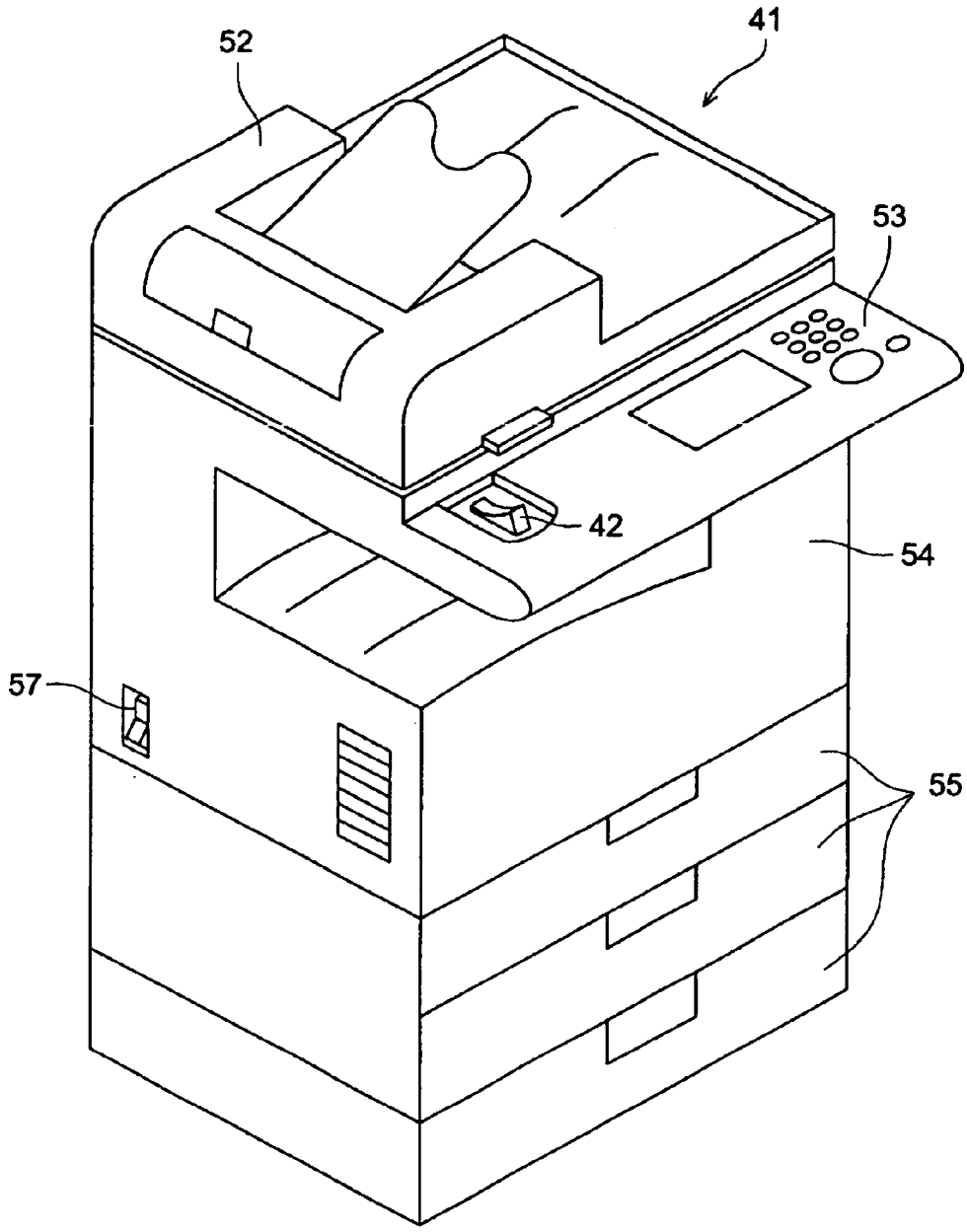
FIG. 4 is a perspective view of an image forming apparatus of the present invention.
Figure 5:
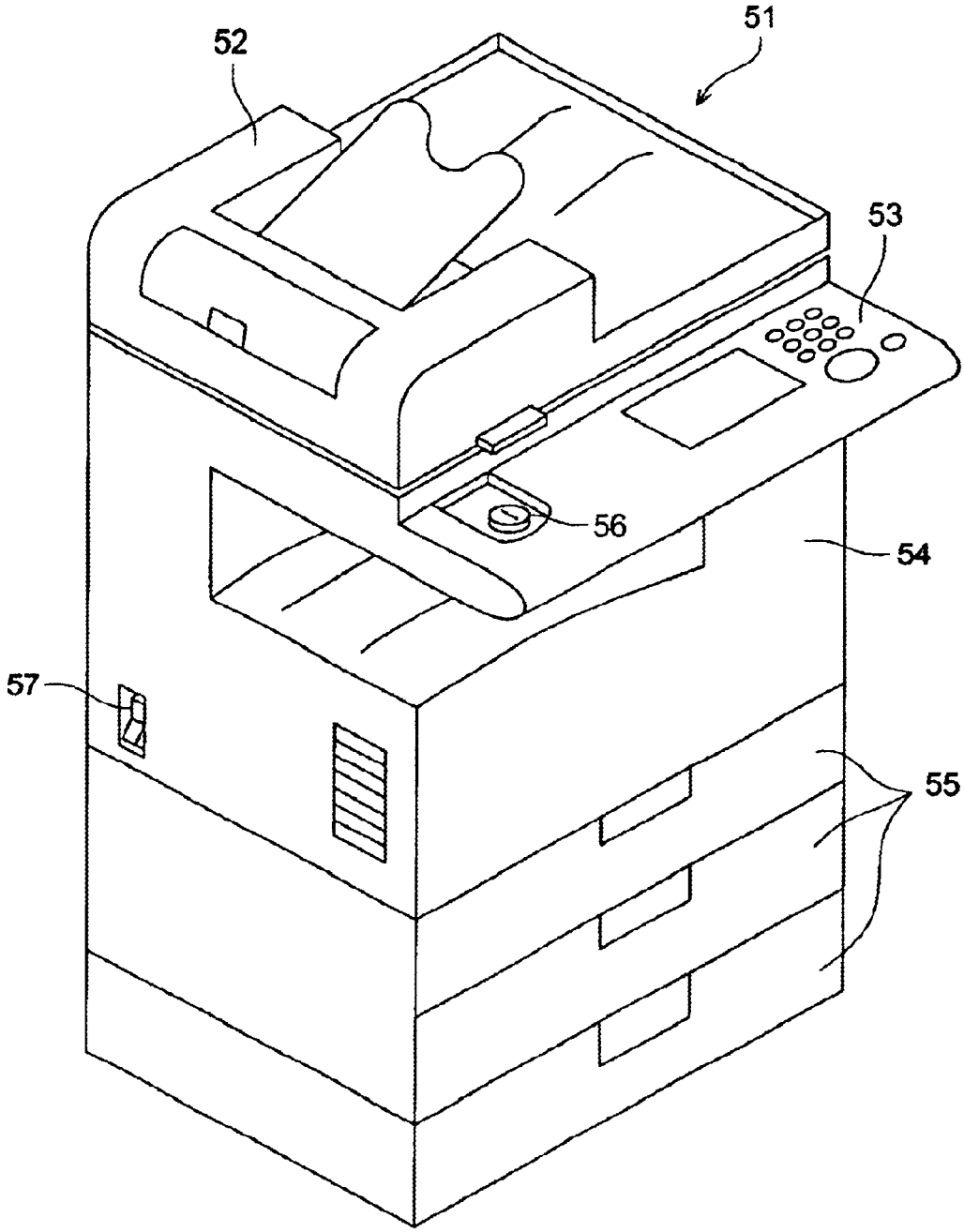
FIG. 5 PRIOR ART
FIG. 5 is a perspective view of a conventional image forming apparatus.
Figure 6:
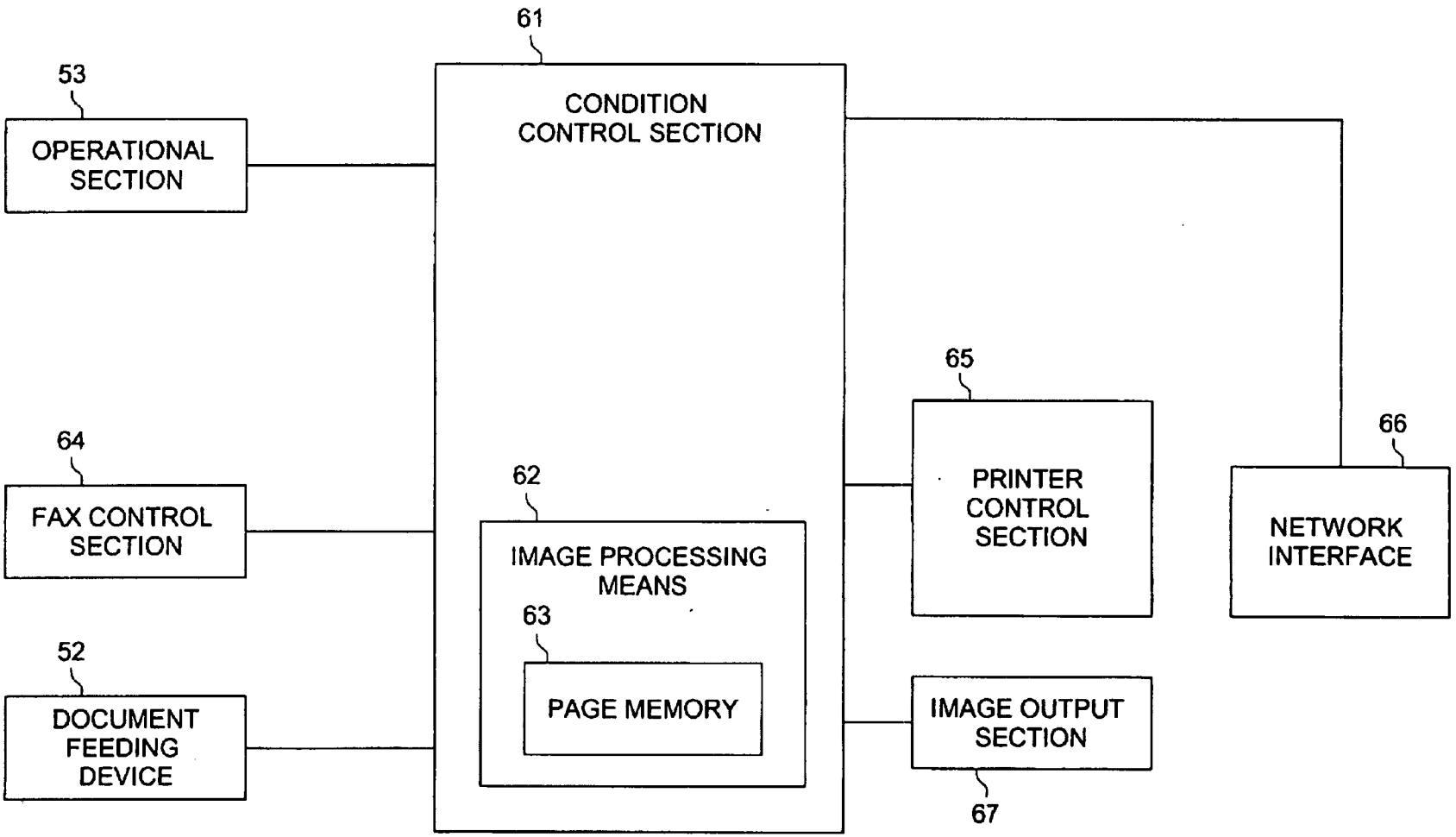
FIG. 6 is a block diagram of an image forming apparatus.

FIG. 4 is a perspective view of the image forming apparatus of the present invention. Since a document feeding device, an operational section, an image forming section, a sheet storage tray and a main power supply switch, which are employed in image forming apparatus 41 of the present invention, are the same which are employed in the conventional image forming apparatus 51 respectively, they are given the same numerical symbols. Main power supply switch 57 is a switch for making or breaking the primary side voltage, and operational power supply switch 42 is a switch for making or breaking the secondary side voltage. Further, switch 11 shown in FIG. 1 is used for operational power supply switch 42.

The followings are preferable embodiments of the present invention.

Under the ON condition of the power supply switch and the OFF condition of the operational power supply switch, when a signal to operate the image forming apparatus is entered, the operational power supply switch is turned on by the electric signal to prepare an output of images as described above. However, when the operational power switch is turned off manually before the output of the images, it may be preferable that the image forming apparatus outputs the images after a predetermined time interval. In this case, it may be preferable that the predetermined time is changeable.

Further, when an amount of backup memory for memorizing facsimile data is insufficient, it may be preferable that a warning is displayed on an operational section, even when the operational power supply switch has been turned off manually.

Image forming apparatus 41 features an electric power saving mode. When both operational power supply switch 42 and main power supply switch 57 have been activated, and when image forming apparatus 41 has not been operated for a predetermined time interval, condition control section 61 activates transistors T2 and T3 shown in FIG. 2, to turn off operational power supply switch 42. Due to this, the secondary voltage is turned off, and image forming apparatus 41 enters a stand-by mode in which the electric power consumption is lowered.

When image forming apparatus 41 is in the stand-by mode, and when image data are received through a FAX or a network interface, condition control section 61 activates transistors T2 and T3 in the circuit shown in FIG. 2 to turn on operational power supply switch 42, and thereby, image forming apparatus 41 enters a functional mode, in which the electric power consumption is higher, so that it can form the received images on the transfer sheet. When the printing is completed, condition control section 61 activates transistors T1 and T4 to turn off operational power supply switch 42.

As explained above, though the control is performed by condition control section 61, a slanting direction of handle 14 can be changed, and thereby, even physically handicapped person having visual disorders can recognize the condition of image forming apparatus 41 by touching the handle section of operational power supply switch 42.

The switch of the present invention is not limited to the seesaw switch, the switch of the present invention allows application of a sliding type switch. However, from the point of view of the universal design, in order to satisfy the desired condition of recognition by touching, or operation by a single hand with light power, the seesaw switch is preferable.

As mentioned above, according to the switch of the present invention, a switch of the present invention is featured as one employing a contact to make and break an electrical circuit, and an electromagnet, both of which are installed in a case, and a handle to make and break the contact by operation from outside of the case, wherein a permanent magnet is installed with one of its poles facing the electromagnet inside of the handle, and wherein the direction of the current passing through the electromagnet is changed so that the permanent magnets are attracted to or repelled from control the handle, and thereby, the contact is opened or closed, and accordingly, the power supply can be automatically turned on or off, and thereby, even a physically handicapped person having a visual disorder can easily recognize the on/off condition of the power supply.

The above-mentioned switch is the seesaw type switch so that the operation can be performed with less power, which even physically handicapped person can easily operate.

According to the image forming apparatus of the present invention, an image forming apparatus of the present invention is featured as one employing an image forming section for forming images on a transfer sheets, an operational section by which the user establishes the image forming apparatus, a condition control section for controlling the image forming section and the operational section, a main power supply switch for directly turning on or off a primary side voltage of the image forming apparatus, and an operational power supply switch that is able to detect the switched condition of a secondary side voltage being turned on or off by the condition control section, wherein the operational power supply switch is the switch of the present invention, and thereby, even physically handicapped persons having a visual disorder can easily identify the on/off condition of the image forming apparatus.

Since the image forming apparatus is structured in such a manner that when the image forming apparatus has not been operated for more than a predetermined time, though both the main power supply switch and the operational power supply switch are in the ON condition, an electrical signal is given to the operational power supply switch so that the switching condition is turned off, then the electric wattage of the image forming apparatus is shifted to a lower consumption mode, still further, when the image forming apparatus receives an operating instruction from outside, the electrical signal is given to the operational power supply switch so that the switching condition is turned ON, then the electric wattage of the image forming apparatus is shifted to a higher consumption mode, even physically handicapped persons having a visual disorder can easily use the image forming apparatus, and at the same time, lower energy consumption is effected for the image forming apparatus.

What is claimed is:

1. A switch, comprising:

a handle for switching the switch;

a first push-section and a second push-section located at respective ends of the handle to be pushed down manually or driven magnetically;

a first permanent magnet with a first pole facing downward, fitted in a lower part of the first push-section and movable with the handle;

a second permanent magnet with a second pole facing downward, fitted in a lower part of the second push-section and movable with the handle;

an electromagnet, fixed below the first and second permanent magnets, with a first magnetic pole of the electromagnet facing the first permanent magnet, and with a second magnetic pole of the electromagnet facing the second permanent magnet; and a first electrical contact and a second electrical contact for switching an electrical circuit on and off;

wherein when the electromagnet is energized by a first electrical current, the first permanent magnet is attracted to the first pole of the electromagnet, while the second permanent magnet is repelled to the second pole of the electromagnet, so that the first push-section is driven magnetically to bring the first electrical contact in contact with the second electrical contact, and wherein when the electromagnet is energized by a second electrical current, whose flowing direction is opposite to a flowing direction of the first electrical current, the first permanent magnet is repelled to the first pole of the electromagnet, while the second permanent magnet is attracted to the second pole of the electromagnet, so that the second push-section is driven magnetically to separate the first electrical contact from the second electrical contact.

2. The switch in claim 1, wherein the switch comprises a seesaw switch.

3. The switch in claim 1, wherein the first pole of the first permanent magnet and the second pole of the second permanent magnet have a same magnetic polarity.

4. An image forming apparatus, comprising:

a power supply switch to turn ON and OFF a primary side voltage, and an operational power supply switch to turn ON and OFF a secondary side voltage by an electric signal from a condition control section, wherein the switch in claim 1 is the operational power supply switch.

5. The image forming apparatus in claim 4, wherein under the ON condition of the power supply switch and the operational power switch, when the image forming apparatus has not been operated for a predetermined time, the operational power supply switch is turned OFF by an electrical signal, and when a signal to work is entered, the operational power switch is turned ON by the electrical signal.

6. The image forming apparatus in claim 4, wherein under the ON condition of the power supply switch and the OFF condition of the operational power supply switch, when a signal to operate the image forming apparatus is entered, the operational power supply switch is turned on to prepare an output of images, and when the operational power switch is turned off manually before the output of the images, the image forming apparatus outputs the images after a predetermined time interval.

7. The image forming apparatus in claim 6, wherein the predetermined time interval is changeable.

8. The image forming apparatus in claim 4, wherein when an amount of a backup memory for memorizing facsimile data is insufficient, a warning is displayed on an operational section, even when the operational power supply switch has been turned off manually.

9. The switch in claim 1, wherein the electromagnet is energized at least during the time when the electromagnet attracts and repels the permanent magnets.

10. The switch in claim 1, further comprising:

a spring member for holding a switched position of the first and second push-sections.

11. A switch for switching on and off an electric circuit, comprising:

a handle for actuating the switch;

a first push-section and a second-push section located at respective upper portions of the handle to be pushed down manually, wherein the handle is structured such that when the first push-section is pushed down the second-push section moves upwardly, and when the second push-section is pushed down the first-push section moves upwardly;

a permanent magnet fitted at a lower portion of the handle at a position below the first push-section;

an electromagnet fixed below the permanent magnet; and a first electrical contact and a second electrical contact for switching the electrical circuit on and off, wherein the first electrical contact is structured to move in an interlocking manner with the handle;

wherein when the electromagnet is energized by a first electric current, the permanent magnet is attracted to the electromagnet so that the first push-section is pulled down and the first electrical contact is brought in contact with the second electrical contact, and wherein when the electromagnet is energized by a second electric current whose flowing direction is opposite to the flowing direction of the first electric current, the permanent magnet is repelled from the electromagnet so that the first push-section is pushed up and the first electrical contact is separated from the second electrical contact.

12. The switch according to claim 11, further comprising a spring member for holding the handle at switching positions.

13. The switch according to claim 11, wherein the electromagnet is energized only when the first push-section is pulled down or pushed up.

* * * * *